United States Patent [19]

Martensson

[11] 4,294,362

[45] Oct. 13, 1981

[54] PARALLELEPIPEDIC PACKING CONTAINER

[75] Inventor: Kjell H. Martensson, Malmö, Sweden

[73] Assignee: Tetra Pak International AB, Lund, Sweden

[21] Appl. No.: 144,862

[22] Filed: Apr. 29, 1980

[30] Foreign Application Priority Data

May 10, 1979 [SE] Sweden ..... 7904103

[51] Int. Cl.[3] ..... B43M 7/00; B65D 5/70; B65D 5/54

[52] U.S. Cl. ..... 206/622; 229/7 R; 229/17 R; 206/633

[58] Field of Search ..... 229/7 R, 17 R, 55; 206/622, 633

[56] References Cited

U.S. PATENT DOCUMENTS

| | | | |
|---|---|---|---|
| 3,795,359 | 3/1974 | Rausing | 206/622 X |
| 3,998,380 | 12/1976 | Kanelous | 229/17 R |
| 4,088,260 | 5/1978 | Stark et al. | 229/17 R |

*Primary Examiner*—George T. Hall

*Attorney, Agent, or Firm*—Burns, Doane, Swecker & Mathis

[57] ABSTRACT

Parallelepipedic packing containers of the type used as non-returnable packages for milk, etc., are manufactured by the transverse sealing of a packing material tube filled with contents. On sealing and subsequent forming of the packages, on the one hand, sealing fins extending over the end walls of the packing container, on the other hand, triangular corner lugs located on the short sides of the end walls are obtained. The sealing fins as well as the corner lugs are folded down during the forming so as to lie against adjoining container walls.

When the packing container is to be opened, one end of the one of the sealing fins is folded up from its folded-down position, whereupon the packing container can be opened in that the packing container material is torn up along a tearing indication running along the fin. The folding up of the fin as well as the subsequent tearing up are facilitated in accordance with the invention in that one of the fins is given a greater width at the end where the tearing indication is situated.

At the same time the opposite end of the fin is made narrower so as to facilitate the folding down of the triangular corner lug located underneath the fin end. This special shape of the fin is achieved without any appreciable increase in cost or loss in material in that the cutting off of the material tube is carried out somewhat obliquely in relation to the transverse sealing zone.

12 Claims, 3 Drawing Figures

PARALLELEPIPEDIC PACKING CONTAINER

The present invention relates to a parallelepipedic packing container comprising two sealing fins extending over oppositely situated walls of the packing container, in which sealing fins the packing material layers forming the packing container are joined to one another in a liquidtight manner, and which sealing fins also extend over double-walled triangular lugs situated at opposite ends of the said packing container walls, one of the sealing fins, which is situated on the upper wall of the packing container being provided with a tearing indication at its one end which is located in an unsealed area between a sealing line extending along the fin and the base line of the fin adjoining the said wall.

Packing containers of the non-returnable type for the packaging of milk, etc, are usually manufactured from a flexible laminate material which comprises a carrier layer of paper coated on both sides with thin layers of liquid-tight, heat-sealable plastic material, e.g. polyethylene. In the manufacture of the packing containers the packing material is first converted to tubular shape by sealing together its longitudinal edges in a liquidtight manner. Thereafter the tube is filled with contents and divided into individual packing containers by repeated flattenings and seals in transverse sealing zones situated at a distance from one another. In connection with the sealing of the tube the same is subjected to a forming process so as to impart a parallelepipedic shape to the packing containers. On completion of the forming, the individual packing containers are separated from one another by cuts in the sealing zones. The finished packing containers are substantially parallelepipedic and are provided with two flattened sealing fins extending over oppositely situated end walls, which also extend over double-walled triangular lugs adjoining these walls which for geometrical reasons are formed from excess material during the formation of the packing containers. In order to keep them out of the way, and so as not to disturb the regular parallelepipedic shape, the sealing fins as well as the flattened corner lugs are folded in against adjoining packing container surfaces. After this the packing container is ready.

It is known that in connection with the said triangular, double-walled lugs and with the sealing fin, different types of tearing perforations may be arranged, by means of which an emptying opening for the package can be created. An example of such a tearing perforation is given in Swedish patent application No. 7900315-8, where the tearing perforation is arranged along a part of the baseline of the sealing fin situated on the upper end of the packing container, that is to say, the connecting line of the fin to the adjoining container wall. The sealing fin is provided with a relatively narrow sealing line extending in longitudinal direction of the fin wherein the material layers included in the sealing fin are joined to one another. This sealing line is situated at a distance from the baseline of the fin and the tearing perforation is thus located in the area of the fin where the layers making up the fin are not joined to one another. The tearing indication, constituted of a perforation line which penetrates the carrier layer of the packing material but not its liquidtight layers, extends from end of the sealing fin (or the tip of the adjoining triangular lug) to a point substantially centrally between the two ends of the sealing fin.

In the packing container described in the above-mentioned Swedish patent application the sealing fin situated on the upper end of the packing container has been provided with an appreciably greater width than that required on the grounds of formation or tightness. The reason for this is that it should be possible for the consumer, after he has folded up the fin, to grip the same between thumb and forefinger and in this manner initiate a break and continue to tear along the tearing perforation when opening the packing container. It has been found, however, that this wide sealing fin causes certain difficulties for the consumer when the sealing fin is to be folded up as a preparation for the opening. These difficulties arise from the fact that the rear end of the sealing fin, like the end of the sealing fin situated at the tearing indication, projects over a flattened corner lug folded down against one sidewall of the packing container. On folding up of only one of the corner lugs and subsequent raising of the one end of the sealing fin, the outer, free edge of the sealing fin, therefore, would have to be stretched, which is impossible, however, owing to the low elasticity of the material. This problem can be solved theoretically by the corner lug folded down at the opposite or rear end of the sealing fin also being folded up so that the sealing fin would be raised over its whole length. Such a procedure, however, would lead to an appreciable weakening of the top part of the packing container, so that it would be easily deformed as it is gripped with one hand when the contents are poured out.

It is a further disadvantage of the packing container described that the wide sealing fin makes more difficult the folding down of the corner lug situated at the rear end of the fin so as to lie against the side of the packing container. A badly folded-in corner lug makes the handling of the packing container more difficult and entails an increased risk for deformation of the same. This is only partly true for the corner lug on which the tearing indication is situated, since it is an advantage here if this corner lug does not rest tightly against the side of the packing container, but can readily be gripped and detached when the packing container is to be opened.

It is the object of the present invention to eliminate the above-mentioned disadvantages and to provide a parallelepipedic packing container with a readily openable tearing indication.

It is a further object of the present invention to optimize the opening function of the packing container described in the above-mentioned Swedish patent application without any extra effort or cost.

These and other objects have been achieved in accordance with the invention in that the parallelepipedic packing container described in the introduction has been given the characteristic that the free edge of the sealing fin extends at an angle to the base line, the width of the fin being the greatest at the end of the fin where the tearing indication is situated. The end of the sealing fin on the side of the tearing indication will consequently be wide and suitable for gripping, and easy to identify for the consumer who wishes to open the package, whilst the opposite end of the sealing fin will be narrow and will not hinder the folding in of the corner lug situated at this end.

Preferred embodiments of the packing container in accordance with the invention have been given the further characteristics which are evident from the subsidiary claims.

A preferred embodiment of the parallelepipedic packing container in accordance with the invention will now be described in detail with special reference to the enclosed schematic drawings which indicate only the parts necessary for an understanding of the invention.

Figure 1:
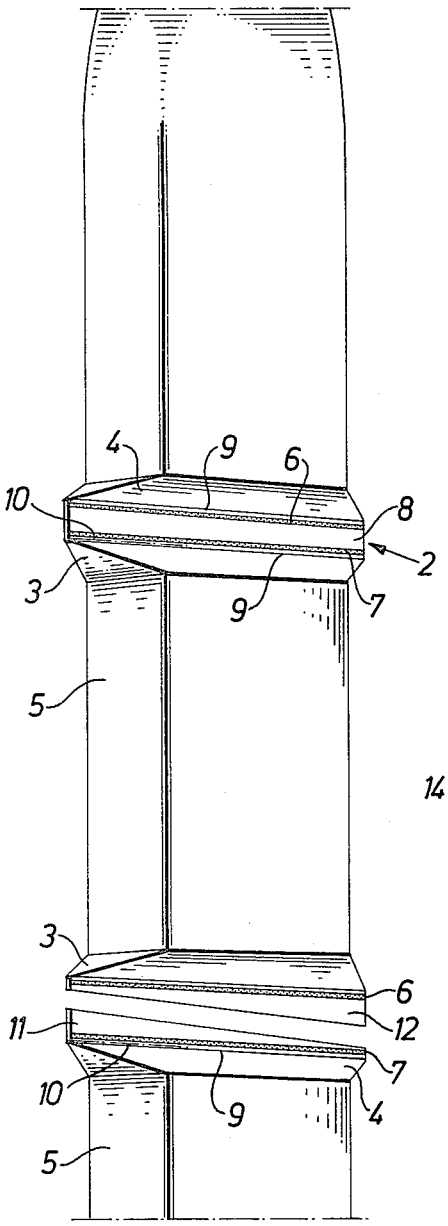
FIG. 1 illustrates a method for the manufacture of a packing container in accordance with the invention.

FIG. 1 shows how a tube of packing material which has been produced from a packing material web, is successively formed to parallelepipedic packages which are sealed and separated from the tube. For the sake of clarity all the machine components, that is to say forming elements, sealing jaws, cutting devices, etc, have been omitted. However, these elements are well known to those versed in the art and are described in detail, e.g. in Swedish Pat. Nos. 324.132 and 324.986.

After the weblike packing material has been converted to a tube 1, in the course of a substantially downwards movement through a manufacturing machine not shown in the drawing, the edges of the packing material web are sealed along a sealing joint situated along the tube (not shown in FIG. 1). Subsequently, the packing material tube 1 is filled with the contents and is flattened in successive transverse zones 2. At the same time the portions of the packing material tube 1 situated in between are so formed by means of forming devices, not shown in the drawing, that a substantially rectangular cross-section is obtained. Adjoining the flattened areas substantially triangular double-walled lugs 3 are obtained which border on the flattened zones 2 as well as on the end and side walls 4 and 5 respectively of the packing containers.

In each of the flattened zones 2 the walls of the packing material tube are pressed against one another with such a force that the contents present in the tube are displaced until the inner plastic layers of the packing material lie flat against one another. Through activation of the heating elements on the sealing jaws (not shown in the drawing) the said thermoplastic layers are subsequently caused to fuse together in two sealing lines 6, 7 extending along the flattened zone. The sealing lines run parallel with the flattened zone and at some distance from each other, so that an unsealed area 8 is obtained between them. In other words, the seals are situated substantially adjoining the base lines 9 which separate the flattened zone 2 from the adjoining end walls 4.

In the packing material web a tearing perforation line 10 has been arranged in advance, which during the process converting the web to a packing container is guided so that it is located within the flattened zone 2 in the vicinity of its base line 9 and more particularly between the base line 9 and sealing line 7 bordering on the same at the one end of the flattened zone 2.

When the partly formed packing containers are to be separated from one another a cut is made through the packing material in the flattened zone 2. The cut is placed in the unsealed area 8 between the two sealing lines 6 and 7 and lies somewhat obliquely in relation to the longitudinal direction of the flattened zone, so that one end of the cut will touch one end of the sealing line 6 whilst the opposite end of the cut touches the opposite end of the sealing line 7. Consequently, the flattened zone 2 is divided into two sealing fins 11 and 12 respectively, both of which have a wider and a narrower end. The sealing fin 11, which subsequently will be positioned on the top end of the finished packing container, is so oriented that its width is greatest at the end of the fin where the tearing indication is situated. The free edges of the sealing fins 11, 12 preferably extend at a right angle from the wide end of the sealing fin to the narrow end of the sealing fin where, as mentioned previously, the edge directly adjoins one end of the sealing line 7. The sealing fin 12 which afterwards will be situated at the bottom of the packing container, is formed in the same manner except that its width tapers off in the opposite direction.

Figure 2:
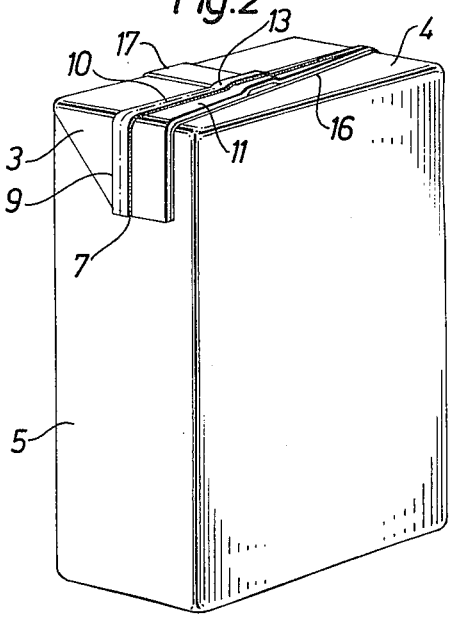
FIG. 2 shows a packing container in accordance with the invention.

In FIG. 2 the finished packing container is shown in perspective representation and the figure clearly indicates how the sealing fin 11 situated at the top end of the packing container, in the final formation of the packing container is folded down against the end wall 4 of the packing container. The sealing fin 11 extends on the one hand over the said end wall 4, on the other hand over the substantially triangular double-walled lugs 3 (only one of which is visible in the drawing) which are likewise folded down against the side wall 5 of the packing container. The tearing perforation arranged in the sealing fin 11 as mentioned earlier extends between the base line 9 of the sealing fin and its sealing line 7. The tearing indication 10 extends from the wide end of the sealing fin, that is to say, the end which coincides with the free corner of the triangular lug 3, along the portion of the fin 11 situated on the triangular lug 3 and further over the portion of the fin situated on the packing container wall 4 to end in a point 13 on the central portion of the top end wall 4 of the packing container (at some distance from the longitudinal seal 17 visible in this figure). Accordingly, the tearing indication is substantially twice the length of the portion of the sealing fin 11 situated on the triangular lug 3 which makes it possible, as shown in FIG. 3, to form a pouring spout 14 with a relatively large emptying opening 15 after the tearing indication 10 has been torn open.

To facilitate the formation of a pouring spout 14 on opening of the packing container, the top end wall 4 of the packing container is provided with crease lines 15 along which the parts of the package which are to form the pouring spout 14 can readily be folded. The end point 13 of the tearing perforation 10 should be substantially located close to the point of intersection of the crease lines 15.

Figure 3:
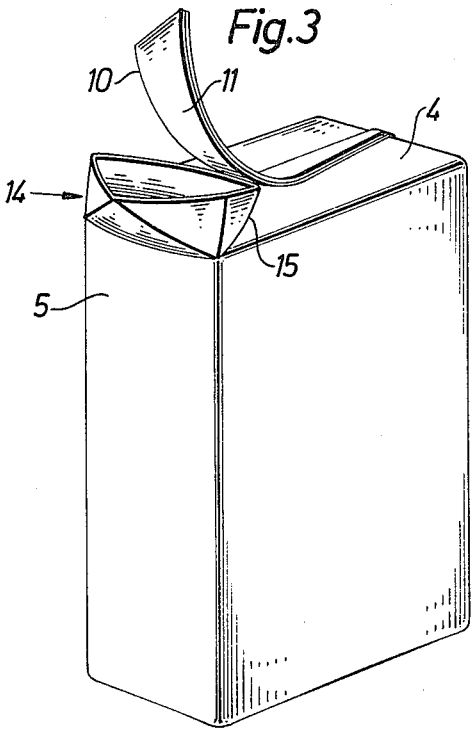
FIG. 3 shows the packing container according to FIG. 2 in open condition.

The sealing fin 12 situated at the bottom of the packing container, as also the triangular corner lugs situated at the bottom, is folded in against the bottom wall of the packing container and is therefore not visible in FIGS. 2 and 3.

In FIG. 3 is shown how the packing container is opened in that the triangular lug 3 folded down against the sidewall 5 of the package is folded up, whereupon the wide end of the sealing fin 11 is folded up to a position substantially at a right angle to the top end wall 4 of the packing container. Then the wide end of the sealing fin 11 is gripped between thumb and forefinger and torn off along the tearing perforation 10. A substantially linearly shaped opening is formed which can be widened to the rhomboid shape shown in FIG. 3 in that the corner lug 3 is folded a little further upwards at the same time as the parts of the packing container material forming the pouring spout are folded about the crease lines 15. It has been shown that this construction provides an inherently stable pouring spout with a large emptying opening which appreciably facilitates the pouring out of the contents.

The sealing lines 6, 7 need not necessarily extend parallel with the base lines of the sealing fins, but they can instead run parallel with the free, oblique edge lines of the fin. With such an orientation the sealing lines can be placed more closely together, which facilitates the displacement of the contents when the tube is transversely squeezed together and sealed, but greater precision in the cutting of the tube will then be necessary.

The wide end of the sealing fin 11 is at least twice as wide as the narrow end. Consequently, the folding up of the wide end of the sealing fin 11 from the position shown in FIG. 2 to a position substantially at a right angle to the top end wall 4 is made very much easier, since the part of the sealing fin extending over the opposite corner lug of the end wall is relatively narrow and offers little resistance to the folding up of the wider end of the sealing fin. This is due, of course, to the fact that the free edge 16 of the sealing fin (FIG. 2) where it passes over the rear limiting line of the top end wall 4 is at a very short distance from the base line 9 of the sealing fin, which means that the sealing fin when its front end is folded up does not have to be stretched to any great extent along its free edge 16.

During the continued opening of the packing container in accordance with the invention the tearing up of the tearing perforation 10 is facilitated owing to the wide end of the sealing fin being at least twice as wide as the distance between sealing line 7 and base line 9, thus providing a large space for the fingers when the breaking of the tearing perforation 10 is to be initiated.

It is a further advantage of the packing container in accordance with the invention that the obliquely cut sealing fin 11 on the one hand provides a clear indication as to which end of the packing container is to be opened, whilst making it practically impossible to open it at the wrong end, since the sealing fin is here so narrow that any attempt at opening will probably be unsuccessful.

It has been found in practice that packing containers in accordance with the invention are better usable and more easy to open than earlier similar designs. These advantages were obtained without requiring greater quantities of material for the manufacture of the packing containers than for earlier packing containers of a similar type and without having to convert existing machinery to any great extent, which renders the packing containers in accordance with the invention highly competitive.

I claim:

1. A packing container of the type having an end wall and adjacent side walls and being substantially in the shape of a parallelepiped, said container comprising:

a sealing fin integral with said end wall, said sealing fin having a free edge, and when said container is sealed said fin overlies said end wall and a portion of an adjacent side wall;

said sealing fin including a triangular lug extending from said end wall and overlying said side wall;

a tear line in said sealing fin extending from a point adjacent said triangular lug along a portion of said sealing fin;

said free edge of said sealing fin being oblique with respect to said end wall and having a greater width adjacent said triangular lug than adjacent the opposite end of said sealing fin.

2. The packing container according to claim 1 wherein said sealing fin includes at least two layers of material sealed together along a seal line.

3. The packing container according to claim 2 wherein said sealing fin is joined to said end wall along a base line, and said tear line is positioned between said seal line and said base line.

4. The packing container according to claim 1 further comprising:

an additional end wall which is connected to said side walls;

an additional sealing fin integral with said additional end wall, said additional fin overlying said additional end wall when said container is sealed; and said additional sealing fin including an additional triangular lug extending from, and overlying, said additional end wall.

5. The packing container according to claim 1 wherein one end of said sealing fin, adjacent said triangular lug, includes an outer edge, and said free edge extends at substantially a right angle from said outer edge of said one end to said opposite end of said sealing fin.

6. The packing container according to claim 4 wherein a width of said additional sealing fin increases from one end of said additional sealing fin toward the opposite end of said additional sealing fin, said one end of said additional sealing fin being substantially aligned with an end of said sealing fin adjacent said triangular lug, and the opposite end of said additional sealing fin being substantially aligned with the opposite end of said sealing fin.

7. The packing container according to claim 1 wherein said triangular lug is folded over said adjacent side wall, and said fin is folded over said end wall and said triangular lug.

8. The packing container according to claim 4 wherein said additional sealing fin is folded over said additional end wall and said additional triangular lug is folded over said additional sealing fin and said additional end wall.

9. The packing container according to claim 1 wherein one end of said sealing fin, adjacent said triangular lug, is at least twice as wide as the opposite end of said sealing fin.

10. The packing container according to claim 3 wherein a width of said sealing fin adjacent said triangular lug is at least twice as great as a distance between said base line and said seal line.

11. The packing container according to claim 1 wherein said tear line extends from an end of said sealing fin proximate said triangular lug along an extent of said sealing fin adjacent said triangular lug, and along a portion of the extent of said sealing fin adjacent said end wall.

12. The packing container according to claim 11 wherein a length of said tear line is substantially twice as great as a width of the end of said sealing fin proximate said triangular lug.

* * * * *